US005371948A

United States Patent [19]

Liffiton

[11] Patent Number: 5,371,948

[45] Date of Patent: Dec. 13, 1994

[54] KNIVES

[75] Inventor: Timothy K. Liffiton, 208 W. Main St., Wapakoneta, Ohio 45895

[73] Assignee: Timothy K. Liffiton, St. Wapakoneta, Ohio

[21] Appl. No.: 168,634

[22] Filed: Dec. 16, 1993

[51] Int. Cl.[5] ..... B26B 1/08

[52] U.S. Cl. ..... 30/163; 30/337; 30/162

[58] Field of Search ..... 30/162, 163, 275.4, 30/289, 335, 336, 337, 338

[56] References Cited

U.S. PATENT DOCUMENTS

| | | | |
|---|---|---|---|
| 472,104 | 4/1892 | Von Bultzingslowen | 30/163 |
| 475,306 | 5/1892 | Franklin | 30/163 |
| 515,743 | 3/1894 | Von Bultzingslowen | 30/163 |
| 1,024,749 | 4/1912 | Joberg | 30/163 |
| 1,453,897 | 5/1923 | Vincent . | |
| 3,863,339 | 2/1975 | Reaney et al. | 30/338 |
| 4,292,738 | 10/1981 | Osada | 30/162 |
| 4,926,555 | 5/1990 | Lemaire | 30/163 |

FOREIGN PATENT DOCUMENTS

| | | | |
|---|---|---|---|
| 0327051 | 12/1902 | France | 30/162 |
| 0662168 | 6/1938 | Germany | 30/163 |
| 0014089 | 5/1902 | Sweden | 30/162 |
| 0017425 | 10/1893 | United Kingdom | 30/162 |

*Primary Examiner*—Eugenia Jones
*Assistant Examiner*—Allan M. Schrock
*Attorney, Agent, or Firm*—Timothy K. Liffiton

[57] ABSTRACT

A self-locking knife which has a guide at the heel of the blade integral with the heel of the knife or attached therewith which blade is mounted in a pair of bolsters superposed on each other, forming a casing for the knife and defining a space or slideway therebetween for passage of the blade from a retracted to an extended position where the blade is projected forwardly of the casing and providing interlock between the blade and the casing, maintaining the blade in either position.

1 Claim, 2 Drawing Sheets

5
25
25
24
13
18
12
11
10
5

22
26
26
9
9
16
21
20
15
29

22

17
27

KNIVES

This invention relates to a knife which has a unique locking and unlocking system and requires only one hand to expose and close the blade, and is self-locking.

BACKGROUND OF THE INVENTION

In the past, safety pocket knives have been provided which slide in a handle and are adapted to have control means associated therewith to facilitate opening and closing of the handle to allow the blade to shift from one position to another as shown in U.S. Pat. No. 475,306. The blade in the pocket knife of the referenced patent is provided with spring jaws or a pawl, which are adapted to be actuated by a push rod.

In U.S. Pat. No. 515,743, the pocket knife is provided with a finger piece to hold the blade in position. In U.S. Pat. No. 1,024,749, a removable pin is employed to engage the back of the blade to prevent the blade from coming back. U.S. Pat. No. 1,453,897 employs a tubular casing, a bar adapted to co-act with a cam upon manipulation of the bar longitudinally of the casing to expose or retract the blade.

In U.S. Pat. No. 1,859,158, a pair of blades are provided which can be adoptably held in different positions.

In recent U.S. Pat. No. 4,926,555, a button is pivotally connected to the rearward end of the blade and is adapted to be pushed on or twisted to release a blade wherefore the same is sunk into the blade.

The prior art presents differences over the present invention and said disclosures either require the use of both hands and none are self-locking.

SUMMARY OF THE INVENTION

The object of this invention is to provide a knife which is adapted to be locked in either an extended or retracted position.

A further object of the invention is to provide a knife which requires only one hand to open and close the blade.

It comprises a blade and guide integrally secured together, the same being mounted preferably within a pair of bolster linings, superposedly secured together and defining a space therebetween within which the blade may be positioned, forming a handle or sheath therefore. The blade is adapted to be slideably moveable within the space or slideway from the handle enclosed retracted position to a blade extended position and in reverse. It is adapted to be locked in either position by one-handed manual contact with portions of the handle casing of the blade by pressure exerted thereon by the person employing the knife, and is adapted to be returned to either position at will and locked therein by simply dropping or raising the knife.

The knife is for use in the military, or for hunting, fishing, or wherever a knife or similar implement can be employed.

The knife is self-locking. Preferably the blade and guide are integrally secured together with locking screws and formed of steel or other suitable knife material.

By simply dropping the knife while exerting pressure on a portion of the handle gripped by the user, the blade is unlocked from its retracted locked position and projected forwardly of the handle and locked in said forward position for use. To retract the knife within the handle, the knife is merely raised straight up, manual pressure is applied to the handle, whereupon the blade slides back into the handle. The interlock within the handle locks the blade securely in the handle in the covered position.

DESCRIPTION OF THE PREFERRED EMBODIMENT

Figures 1, 2, 9, 10:
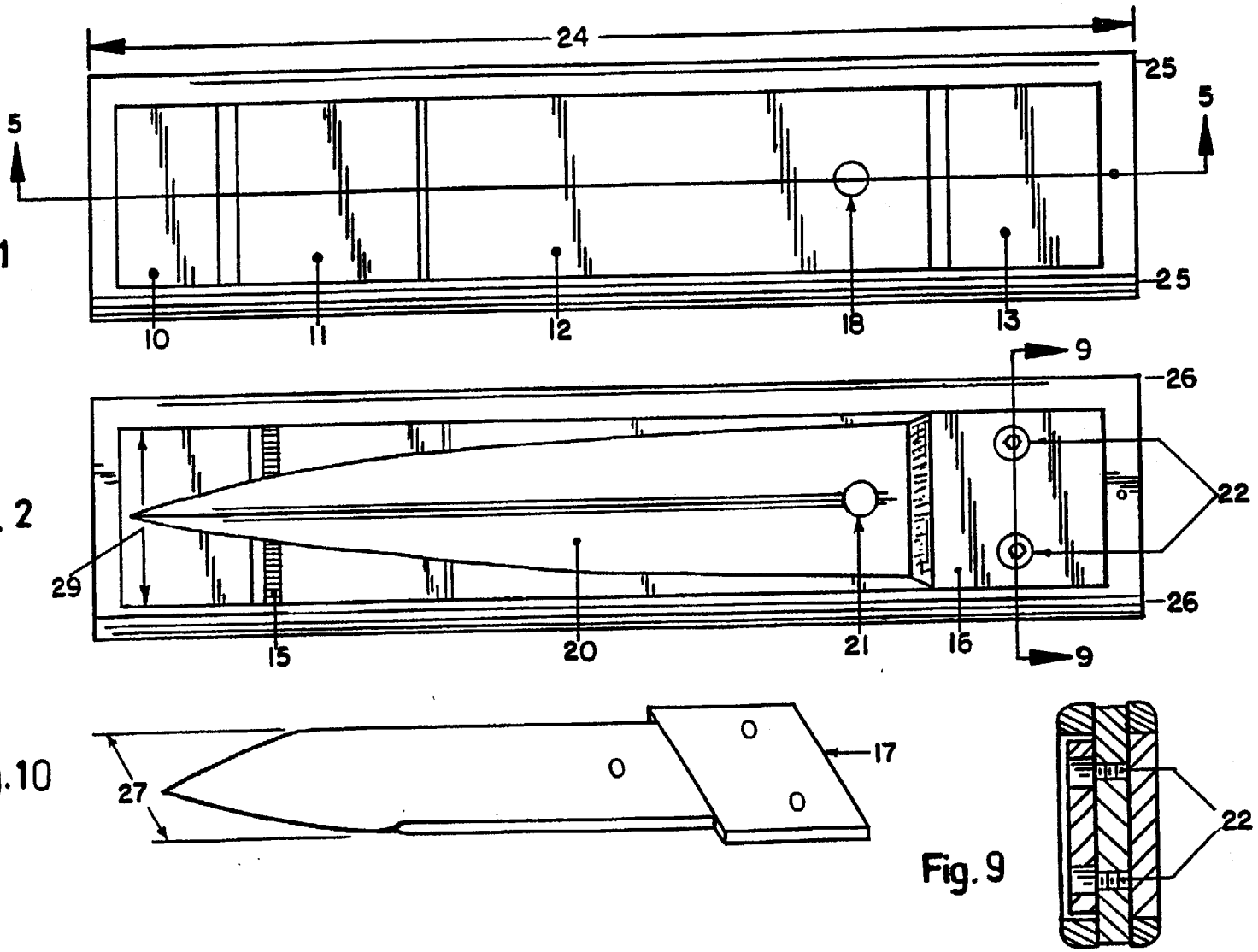
FIG. 1 is the top view of the knife handle, showing the panels and dowel.
FIG. 2 is the bottom view of the knife handle without the bottom cover.
FIG. 9 is the sectional end view of casing along line 9—9 of FIG. 2.
FIG. 10 shows the stepped in portion of the blade.
Figures 3, 4, 5, 6, 7, 8:
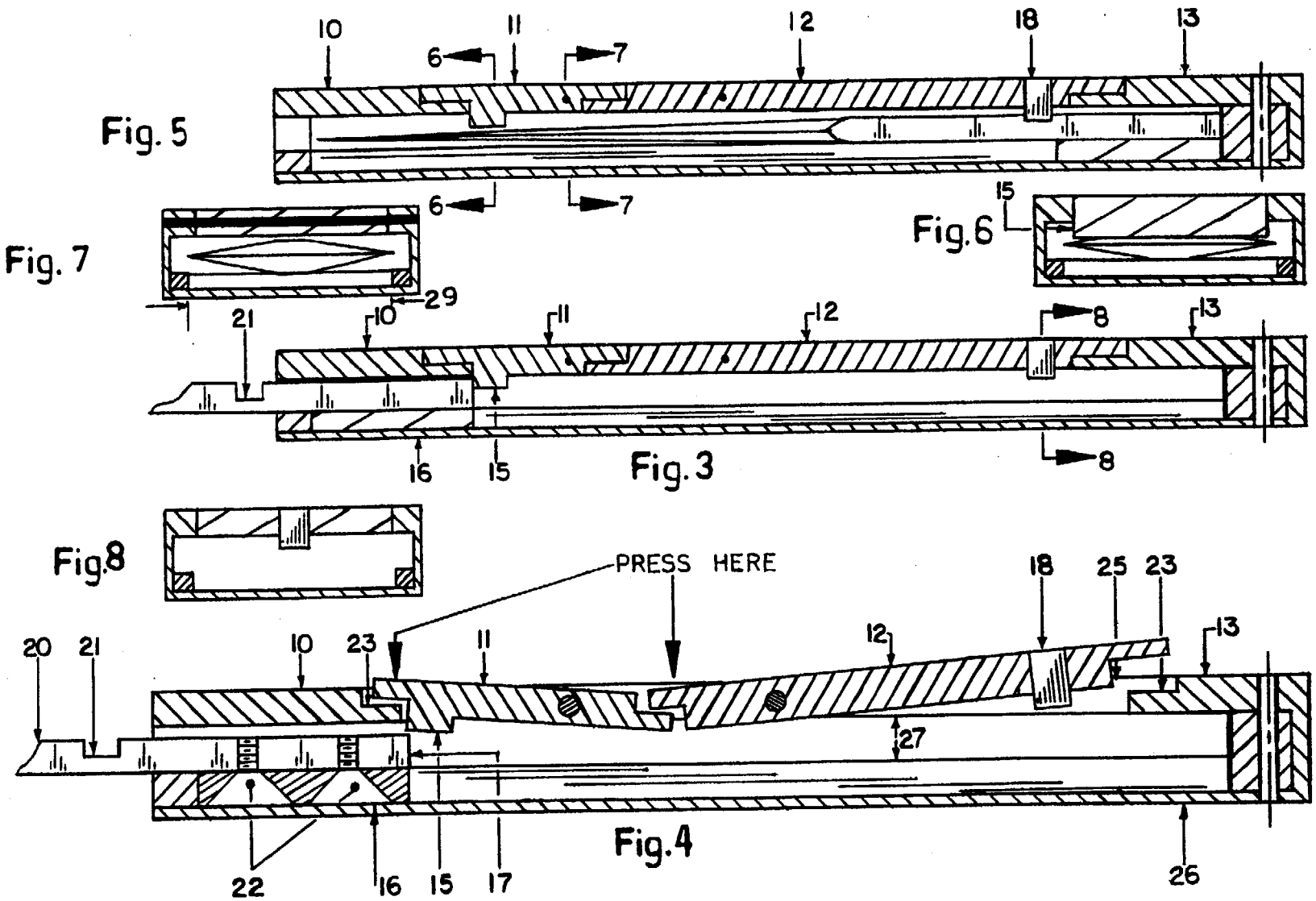
FIG. 3 is the sectional view of FIG. 1, showing blade extended and locked.
FIG. 4 is the sectional view of FIG. 1, showing the operating mechanism.
FIG. 5 is the sectional view from lines 5—5 of FIG. 1, showing the blade locked.
FIGS. 6, 7, and 8 are sectional end view of casing, showing bolster pin 14, locking lug 15, and blade dowel locking lug 18 along lines 6—6, 7—7 of FIG. 5 and line 8—8 of FIG. 3.

Referring now to the drawings in all of which like parts are designated by like reference numerals, in FIG. 2 I show the Improved knife of my invention, which comprises a knife blade 20 adapted to be locked in a casing 24, in (FIG. 1,) forming the handle for the blade, which in the embodiment shown consists of a pair of bolster linings 25 and 26 superposedly fixed to each other, defining a space or slideway 27 (therebetween in FIG. 4.)

The knife blade 20 is provided with a tapered sharpened cutting edge 27, and the hilt thereof is provided with a round opening 21 adjacent to the heel 17, (in FIG. 4) of the blade and centrally thereof, in FIG. 2, which heel 17 is preferably rectangular and stepped in form in FIG. 10 and adapted to be mounted on a rectangular guide 16, in FIG. 2. The blade and the guide affixed thereto rides between the sides of the bolster linings 25 and 26 in the space 29, in FIG. 2 and space 27 in FIG. 4 when the knife is retracted or extended, as hereinafter described and shown in the drawings, in FIG. 3, 4, and 5. The guide 16 is secured to the blade with two Locking screws 22, in FIG. 2, provided with a stepped in portion at the heel FIG. 10, which allows it to abut to the locking lug 15 on panel 11, in FIG. 3. Digital pressure on the anterior portion of panel 12 is used to raise the anterior part of panel 11 and the posterior part of panel 12, in FIG. 4.

The releasing mechanism in the handle may be of any preferred material and is made up of a plurality of aligned panels 10, 11, 12, and 13. These panels are rabbeted and over lap each other 23, in FIG. 5, the rabbeted causes the panels to act in unison. The center panel 12 operates as a releasing panel to permit the blade to slideably move from the retracted or extended position in the handle and to lock the knife in either adjusted position, in FIGS. 3 and 5.

As shown in FIG. 4, when the handle is raised straight up, release of the locking mechanism, dowel 18, by pressure on the anterior portion of panel 12, allows the blade to be retracted into blade covered or retracted position and locked therein, as shown in FIG. 5. The locking is accomplished by the use of a steel dowel 18 mounted on the underside of the rear of panel 12 and inserts into an opening 21 of the blade 20 and holds the blade in its initial retracted position within the knife casing. It will be noted that the panel 11 and its locking lug 15 are adapted to abut against the heel 17 of the blade as shown in FIG. 3. The locking lug 15, adds extra weight to the anterior panel 11, in FIG 4, and when panel 11, is released the blade is locked in place. The blade is extended when the knife is pointed downward, and upon pressing and releasing the anterior portion of panel 12. The heel end 17 of the blade is prevented from rearward movement in the case in the slideway and locked into the blade's extended position, the rear or heel of the blade engaging a locking lug 15 carried on the forward end in panel 11. The knife is shown in FIG. 5 in its original retracted or knife enclosed position and in FIG. 3 in its extended position.

FIG. 5 discloses the dowel or pin 18 in locked engagement with the knife opening to retain the knife in its handle enclosed position.

Panel 12 as shown can be provided with a leaf spring inserted into the middle of, on top, or underneath of the rearward end of the panel 12 and the front end of panel 11, wherefore pressure on the front end of panel 12 exerts pressure on the rear end of panel 11 and raises the front of panel 11, plus the rear of panel 12, thereby unlocking 18, and allowing the blade 20 to slide forward and lock against locking lug 15, in FIG. 3.

When panel 12 is released and panel 11 is pressed down, it locks the blade securely against locking lug 15 inside the frame. in FIG. 3.

The knife enclosure, while it could be formed of blade enclosing means of various types, consists preferably, as shown in FIGS. 1 and 2 inclusive, of a pair of bolster linings 25 and 26 and a plurality of panels on an outer face thereof. A centrally disposed panel 12 is pivotally mounted on the linings and, if one chooses, a leaf spring can be secured at one end medially thereof, which spring is further secured to a relatively shorter adjacent panel 11, which is also pivotally secured to the outer bolster lining, wherefore when manual pressure is exerted on the leaf spring as when gripping the knife for use in its blade extended position, the blade which was released by pointing the knife downward, is locked in the extended position and prevented from movement into the retracted position by means of the downward pressure exerted by the spring causing the forward end of the panel 12 and locking lug 15 to abut the rearward end of the blade 20, in FIG. 4, and preventing any further rearward movement of the knife.

Hence the blade is adapted by means of pressure exerted upon the panel 12 and then on panel 11 to be locked in either operative or non-operative position.

The guide 16 keeps the blade straight while traveling down the bolster lining 26, in space 29, in FIG. 2. This keeps the blade from moving sideways and hanging up, thus not going to completion and locking.

The heel 17, in FIG. 4, rides between the linings 25 and 26 in space 27, in FIG. 4. This heel keeps the blade from moving up and down.

The combination of guide 16, riding between bolster lining 25 and 26 and heel 17, riding in space 27, makes for a very strong, secure, and tight blade, far superior to anything else.

Granted, the guide 16 has added weight and will cause the blade to travel faster, but that is not the main purpose of the guide.

While I have described my invention in a preferred embodiment, I am aware that numerous and other handle and self-locking and release means and that a saw or other type of implement may be attached to the blade or in lieu thereof may also be employed without, however, departing from the spirit of my invention and the scope of the appended claims.

What I claim is:

1. A knife including a manually operated locking and unlocking system, said system comprising a substantially hollow housing having a rectangular cross section in which a blade is slidably mounted, said housing having first and second pairs of opposite faces, the first pair of faces having a larger area than the second pair of faces, said housing further having a rectangular opening in one of said first pair of faces in which an elongate anterior panel and an elongate posterior panel are rabbeted together, each of said panels being pivotally mounted in said opening, said anterior panel having a weighted locking lug on an anterior end that automatically locks the blade in an extended position when the blade has been released, said posterior panel having a pin that automatically locks the blade in a closed position when the blade has been retracted, said system containing no springs to lock and unlock the blade.

* * * * *